US006267691B1

(12) United States Patent
Dammen

(10) Patent No.: US 6,267,691 B1
(45) Date of Patent: Jul. 31, 2001

(54) GOLF CLUB HEAD HAVING IMPACT CONTROL AND IMPROVED FLEXING

(75) Inventor: Per Dammen, Bekkestua (NO)

(73) Assignee: Progolf Development AS, Oslo (NO)

( * ) Notice: Subject to any disclaimer, the term of this patent is extended or adjusted under 35 U.S.C. 154(b) by 0 days.

(21) Appl. No.: 09/228,270

(22) Filed: Jan. 11, 1999

(51) Int. Cl.[7] ..... A63B 53/04
(52) U.S. Cl. ..... 473/329; 473/332; 473/350
(58) Field of Search ..... 473/324, 329, 473/330, 331, 332, 345, 346, 349, 350, 327, 219, 256, 334; D21/747, 748, 749

(56) References Cited

U.S. PATENT DOCUMENTS 3,814,437 * 6/1974 Winquist .
4,511,145 * 4/1985 Schmidt .
5,377,985 * 1/1995 Ohnishi .
5,711,722 * 1/1998 Miyajima .

* cited by examiner

*Primary Examiner*—Sebastiano Passaniti
(74) *Attorney, Agent, or Firm*—Bacon & Thomas, PLLC

(57) ABSTRACT

A golf club head with impact control and improved flexing having an inner end adapted to be fastened to a shaft, an outer end, a front face and a back face. The front face and the back face are defined on opposite sides of a wall which is disposed between the inner and outer ends. The front face is an impact face adapted to hit a golf ball. A cavity is formed by a perimeter frame surrounding the back face. A plurality of mutually parallel ribs on the back face extend along the wall between an inner end portion and an outer end portion of the frame. The ribs extend mainly parallel to a top of the club head.

8 Claims, 1 Drawing Sheet

GOLF CLUB HEAD HAVING IMPACT CONTROL AND IMPROVED FLEXING

BACKGROUND OF THE INVENTION

1. Field of the Invention

This invention relates to a golf club head with impact control and improved flexing.

2. Description of the Related Art

Golf club heads generally comprise an inner end to be fastened to a shaft, an outer end, a front face and a back face, the front face and the back face being situated on opposite sides of a wall. The front face is an impact face adapted to hit a golf ball.

U.S. Pat. No. 5,595,552 issued to Wright et al. shows a golfclub head having a cavity adjacent the back face and surrounded by a perimeter frame. The frame, in particular along the bottom and the outer end of the head, has a relatively large thickness and serves as a weighting element. Ribs are formed on the back face which extend radially from a center of the wall to the perimeter frame. The purpose of these ribs is to eliminate undesirable vibrations in the golf club head during impact against a golf ball and to dampen other vibrations. Also, a ring encircling a projection may be formed on the back face at the center of gravity of the club head. These members, together with the ribs, constitute means for tuning the club head and for controlling vibrations in order to improve the sound and feel of the golf club during impact against a golf ball.

SUMMARY OF THE INVENTION

According to the present invention, it has been recognized that improved dampening of vibrations and a better feel can be achieved by providing a plurality of ribs on the back face extending along the wall. The ribs are mainly preferably parallel to the top of the club head. A particularly desirable effect is achieved by shaping one or more of the ribs in such a manner that their height from the back face is varied, being greatest near a lengthwise middle portion of each rib.

The ribs give the club head a larger "sweetspot" compared with prior art club heads and cause a particular flexing or bending of the club head wall during impact.

The parallel ribs result in particular properties for the club head. The bending stiffness of the club head is different in the lengthwise direction of the ribs relative to the transverse direction of the ribs. The bending of the club head wall during impact will take place in a larger degree along the transverse direction of the ribs than along the lengthwise direction of the ribs; i.e. the ribs will more or less resist bending of the club head wall in a first direction parallel to the ribs while permitting bending in a second direction mainly perpendicular to the first direction.

The above described result may be further increased by shaping the ribs with a varying height, as mentioned above. Ribs having such a varying height may be shaped similar to the deflection curve of a beam mounted at each end and subjected to a bending load at or near its midpoint.

The wall on which the ribs are situated can be made thinner than a corresponding wall without such ribs. The combined stiffness of the wall and the ribs should be adapted to particular users. Professional golf players may use club heads which have a greater stiffness than club heads suitable for amateur players.

The golf club head according to the present invention can be made, for example cast, from any suitable material used for golf club heads, such as steel or metal alloys.

DETAILED DESCRIPTION OF THE PREFERRED EMBODIMENT

Figure 1:
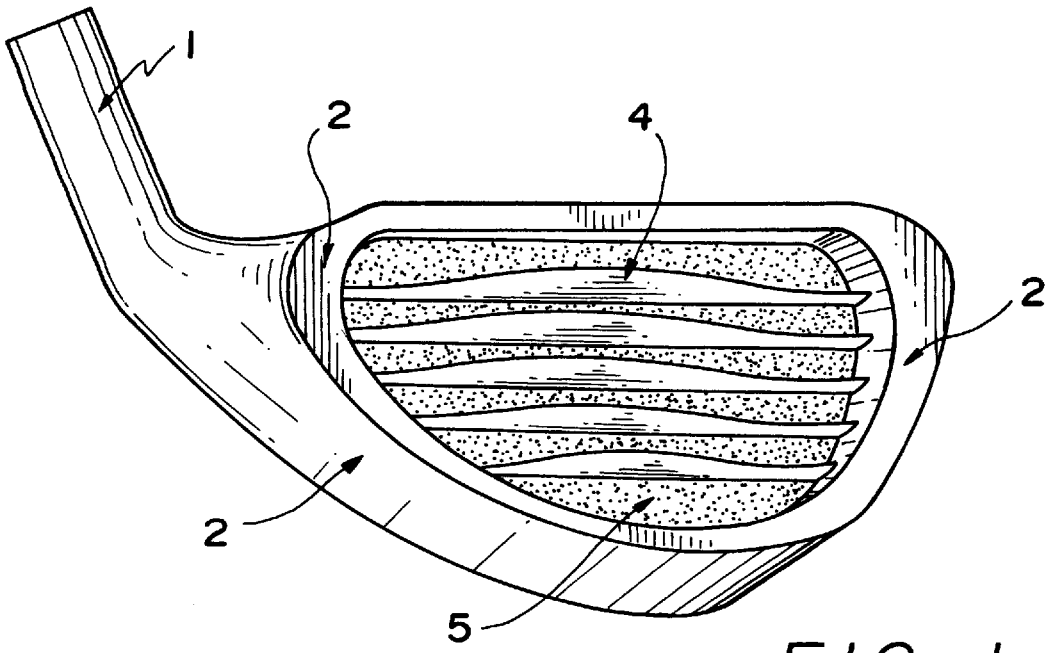
FIG. 1 is a perspective view of a golf club head according to the present invention.
Figure 2:
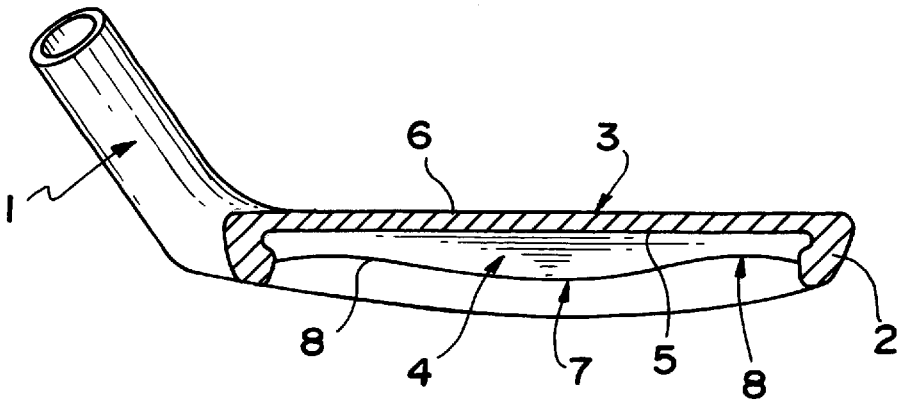
FIG. 2 shows a section through the golf club head of FIG. 1, taken between two ribs.
Figure 3:
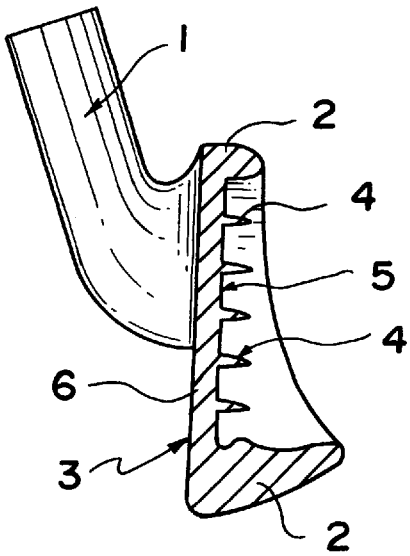
FIG. 3 shows a section through the golf club head of FIG. 1, perpendicular to the section of FIG. 2.

The figures show a golf club head according to the present invention, comprising a socket 1 adapted to be fastened to an end of a club shaft (not shown), a frame 2 surrounding a main portion of the club head, a front face 3 on one side of a wall 6, and a back face 5 on the opposite side of the wall 6. The back face 5 forms the bottom of a cavity which is surrounded by the frame 2. As shown, a plurality of ribs 4 are disposed on the back face 5 within the cavity. The ribs 4 are parallel to each other and preferably are mainly parallel to the top portion of the frame 2 (the upper portion of the frame as shown in FIG. 2). The cross sectional shape of each of the ribs 4 is shown in FIG. 3 to be triangular, but this shape is not a limitation as the cross sectional shape may be, for example, trapezoidal, rectangular or the like.

A preferred longitudinal shape of the ribs 4 is shown in FIG. 2. As shown, each of the ribs 4 is highest in a middle portion 7 and lowest in portions 8 near each end. Thus, the bending stiffness of each rib 4 is greatest in the respective middle portion 7.

The effect of the ribs 4 is that the golf club head has different stiffness properties with respect to two directions: a first direction which is mainly horizontal at the moment of impact; and a second direction which is mainly vertical at the moment of impact. The ribs 4 do not substantially increase the stiffness against bending of the wall 6 in the second direction, such that the wall 6 may become slightly curved as shown in the section of FIG. 3. (The section shows the wall 6 in a slightly curved condition, i.e., not straight). To the contrary, the ribs 4 increase the bending stiffness of the wall 6 in the first direction such that the curvature of the wall 6 at the moment of impact is decreased, as shown in the section of FIG. 2. (The section shows the wall 6 in a straight condition, i.e., not curved.) In other words, the wall 6 has a tendency to bend more during impact in the second direction where bending is not impeded by the ribs as compared with the first direction where the ribs impede bending.

The exact number of ribs 4 is not critical. The desired effect may be achieved with as few as two ribs 4 or with a rather large number, for instance eight. The stiffness of the wall 6 can be adjusted by varying the number, thickness or height of ribs 4, or generally by changing their cross sectional shape, in addition to altering the thickness of the wall 6 itself.

I claim:

1. A golf club head with impact control and flex increasing means, the club head comprising:

an inner end adapted to be fastened to a shaft;

an outer end;

a front face and a back face situated on opposite sides of a wall extending from the inner end to the outer end, the front face being an impact face adapted to hit a golf ball, the back face being surrounded by a perimeter frame so as to form a cavity therein; and a plurality of mutually parallel ribs extending from the back face along the wall between an inner end portion and an outer end portion of the frame, at least one of the ribs having a varying height along a length thereof so as to have a larger height at a lengthwise middle portion of the wall than at the inner and outer end portions of the frame.

2. A golf club head according to claim 1, wherein the ribs extend mainly parallel to a top of the club head.

3. A golf club head according to claim 1, wherein the plurality of ribs comprises between two and eight ribs.

4. A golf club head according to claim 1, wherein all of the ribs have a larger height at the middle portion of the wall than at the inner and outer end portions of the frame.

5. A golf club head with impact control and flex increasing means, the club head comprising:

an inner end adapted to be fastened to a shaft;

an outer end;

a front face and a back face situated on opposite sides of a wall extending from the inner end to the outer end, the front face being an impact face adapted to hit a golf ball, the back face being surrounded by a perimeter frame so as to form a cavity therein; and a plurality of mutually parallel ribs extending from the back face along the wall between an inner end portion and an outer end portion of the frame, at least one of the ribs having a varying height so as to have a larger height at a lengthwise middle portion than at end portions thereof.

6. A golf club head according to claim 5, wherein the ribs extend mainly parallel to a top of the club head.

7. A golf club head according to claim 5, wherein the plurality of ribs comprises between two and eight ribs.

8. A golf club head according to claim 5, wherein all of the ribs have a larger height at the middle portion than at the end portions thereof.

* * * * *